US011819866B2

(12) United States Patent
Vanzetto

(10) Patent No.: US 11,819,866 B2
(45) Date of Patent: Nov. 21, 2023

(54) TURBINE FOR A FLUID-EJECTING DEVICE, FLUID-EJECTING DEVICE, AND ASSEMBLY COMPRISING SUCH A DEVICE AND TOOL

(71) Applicant: EXEL INDUSTRIES, Epernay (FR)

(72) Inventor: Denis Vanzetto, Meylan (FR)

(73) Assignee: EXEL INDUSTRIES, Epernay (FR)

( * ) Notice: Subject to any disclaimer, the term of this patent is extended or adjusted under 35 U.S.C. 154(b) by 283 days.

(21) Appl. No.: 17/256,864

(22) PCT Filed: Jul. 12, 2019

(86) PCT No.: PCT/EP2019/068799
§ 371 (c)(1),
(2) Date: Dec. 29, 2020

(87) PCT Pub. No.: WO2020/011969
PCT Pub. Date: Jan. 16, 2020

(65) Prior Publication Data

US 2021/0252532 A1 Aug. 19, 2021

(30) Foreign Application Priority Data

Jul. 13, 2018 (FR) ..... 1856517

(51) Int. Cl.
*B05B 5/04* (2006.01)

(52) U.S. Cl.
CPC ..... *B05B 5/0407* (2013.01); *B05B 5/0415* (2013.01); *B05B 5/0426* (2013.01)

(58) Field of Classification Search
CPC ... B05B 3/0427; B05B 3/1014; B05B 3/1035; B05B 3/1042; B05B 3/1057;
(Continued)

(56) References Cited

U.S. PATENT DOCUMENTS 4,589,597 A * 5/1986 Robisch ..... B05B 5/0415 239/293
4,927,081 A * 5/1990 Kwok ..... B05B 3/1014 239/223
(Continued)

FOREIGN PATENT DOCUMENTS

JP 8224505 A 9/1996

OTHER PUBLICATIONS

EPO Machine Translation of JP8224505A.
PCT Rapport de Recherche Internationale for Patent Application No. PCT/EP2019/068799, dated Oct. 23, 2019, 2 pp.

*Primary Examiner* — Cody J Lieuwen
(74) *Attorney, Agent, or Firm* — Soquel Group LLC

(57) ABSTRACT

A turbine for a fluid-ejecting device, including a body and a rotor rotating a bowl about an axis, the turbine also including a tube mounted coaxially with the body and intended to be mounted coaxially with a skirt, a first portion of the tube being surrounded by the turbine body and a second portion being surrounded by the skirt and offset in the downstream direction relative to the first portion, the tube being rotatable about the axis relative to the body, the body preventing the translational movement of the tube parallel to the axis, and the outer face of the aforementioned second portion having a first thread engaging with a second thread formed on the skirt in order to press the skirt against the turbine body.

13 Claims, 8 Drawing Sheets

(58) Field of Classification Search
CPC ... B05B 3/1064; B05B 5/0407; B05B 5/0411; B05B 5/0415
USPC ..... 239/293
See application file for complete search history.

(56) References Cited

U.S. PATENT DOCUMENTS

| | | | | |
|---|---|---|---|---|
| 5,397,063 | A * | 3/1995 | Weinstein | B05B 5/053 239/700 |
| 2016/0059248 | A1* | 3/2016 | Yamauchi | B05B 5/0426 239/296 |
| 2017/0128969 | A1 | 5/2017 | Yamauchi | |

* cited by examiner

TURBINE FOR A FLUID-EJECTING DEVICE, FLUID-EJECTING DEVICE, AND ASSEMBLY COMPRISING SUCH A DEVICE AND TOOL

CROSS-REFERENCE TO RELATED APPLICATIONS

This application claims benefit under 35 USC § 371 of PCT Application No. PCT/EP2019/068799 entitled TURBINE FOR A FLUID-EJECTING DEVICE, FLUID-EJECTING DEVICE, AND ASSEMBLY COMPRISING SUCH A DEVICE AND TOOL, filed on Jul. 12, 2019 by inventor Denis Vanzetto. PCT Application No. PCT/EP2019/068799 claims priority of French Patent Application No. 18 56517, filed on Jul. 13, 2018.

FIELD OF THE INVENTION

The present invention relates to a turbine for a fluid spraying device and an associated fluid spraying device. The present invention also relates to an assembly comprising a tool and a device for spraying fluid.

BACKGROUND OF THE INVENTION

Fluid spraying devices are used in many applications, including for spraying paints and other coating materials such as varnishes. These spraying devices frequently comprise a rotating bowl driven in rotation by a turbine, an injector for injecting the fluid into the bottom of the bowl and a skirt for generating air jets to shape the flow of the sprayed fluid.

The skirt is generally attached to a robotic arm of a fluid spraying installation, in particular by screwing the skirt onto a screw thread formed at one end of the arm. Since skirts generally have an external surface with cylindrical symmetry and which is relatively smooth in order to limit the adhesion of the coating products on the skirt, it is often necessary to use a specific tool for this that is suitable for gripping the skirt on its external surface and/or to engage in specific notches provided on the outer surface of the skirt for this purpose.

However, the tools used are complex and it is difficult to control the tightening torque applied using these tools, while a high tightening torque is often necessary in view of the size of the skirts and the importance of their good securing on the arm. In addition, the notches provided on the outer surface form coating product retention zones which therefore participate in accelerated soiling of the skirt and make it difficult to clean. The use of the tools provided to remove the skirt may be difficult when these notches are partially blocked by the coating products.

The positioning of the skirt is therefore difficult to control with precision, since the degree of tightening is liable to vary. This may result in a fall in the quality of the coating product layers deposited, in particular the presence of grains or even the appearance of defects.

There is therefore a need for a turbine of a fluid spraying device which makes it possible to deposit layers of better quality coating product.

SUMMARY OF THE INVENTION

For this purpose, a turbine is proposed for a fluid spraying device, the turbine comprising a body and a rotor designed to drive a bowl in rotation about an axis, called the common axis of rotation, the rotor being surrounded by the turbine body in a plane perpendicular to the common axis, the turbine further comprising a tube having an external face and an internal face, the tube being mounted coaxially with the turbine body and designed to be mounted coaxially with the skirt, a primary portion of the tube being surrounded by the turbine body, a secondary portion of the tube being designed to be surrounded by the skirt, the secondary portion being offset in the downstream direction relative to the primary portion, the tube being movable in rotation about the common axis relative to the turbine body, the turbine body being designed to prevent a translation of the tube parallel to the common axis relative to the turbine body, the secondary portion having, on the external face, a first screw thread designed to engage a second screw thread formed on the skirt to press the skirt against the turbine body.

According to one embodiment, the turbine body has a shape designed to allow the flow of air towards a skirt.

A fluid spraying device is also proposed, comprising a bowl, a turbine as described above, an injector designed to inject the fluid into the bottom of the bowl, and a skirt at least partially surrounding the bowl in a plane perpendicular to the common axis and designed to eject gas jets to shape the sprayed fluid.

According to advantageous but not mandatory embodiments, the fluid spraying device comprises one or more of the following characteristics, taken in isolation or in any technically feasible combination:

- the external face has a shoulder perpendicular to the common axis, the turbine body comprising a support face bearing against the shoulder to prevent translation in the downstream direction of the tube relative to the turbine body.
- the primary portion is delimited along the common axis by the shoulder and has a length, measured along the common axis, greater than or equal to 5 mm.
- the turbine body comprises at least a first part and a second part fixed to one another, the second part being offset in the downstream direction relative to the first part, the tube being at least partially received in a groove delimited in a direction parallel to the common axis by the first part and the second part, the second part bearing against the tube to prevent translation of the tube in the downstream direction relative to the first part.
- the internal face of the secondary portion has, at at least one point, a normal direction, an angle being defined between the normal direction and a segment connecting this point to the common axis, the angle being measured in a plane perpendicular to the common axis and being distinctly greater than 5 degrees.
- a plurality of notches are formed in the internal face of the secondary portion.
- each notch extends in a direction parallel to the common axis.
- the tube has an end face defining the tube along the common axis, the end face facing the downstream direction, each notch opening onto the end face.
- each notch has a bottom, a distance measured in a plane perpendicular to the common axis between the bottom and the common axis being defined for each notch, the skirt comprising an internal face having a symmetry of revolution about the common axis, a minimum diameter being defined for the internal face of the skirt, the distance from each notch being less than or equal to half of the minimum diameter of the skirt.

each notch has a section in a plane perpendicular to the common axis, the section of each notch being an arc of a circle.

There is also proposed an assembly comprising a device and a tool designed to engage the internal face of the secondary portion so as to transmit to the tube a force tending to rotate the tube about the common axis relative to the turbine body.

The description also describes a turbine for a fluid spraying device comprising a turbine body and a rotor designed to drive a bowl in rotation with respect to the body about a common axis of rotation, the rotor being surrounded by the turbine body in a plane perpendicular to the common axis, the turbine body being designed to guide the rotor in rotation, the rotor being designed to be driven in rotation by a flow of gas, the turbine body being designed to receive the flow of gas exiting from the rotor and delimiting at least one outlet duct designed to guide a first part of the flow received in a space delimited in a plane perpendicular to the common axis by the bowl and the skirt.

There is also described a turbine for a fluid spraying device comprising a turbine body and a rotor designed to drive a bowl in rotation relative to the body about a common axis of rotation, the rotor being surrounded by the turbine body in a plane perpendicular to the common axis, the turbine body being designed to guide the rotor in rotation, the turbine body being designed so that the injector and the skirt are directly mounted on the turbine body, the bowl being directly mounted on the rotor.

According to advantageous but not mandatory embodiments, the turbine comprises one or more of the following characteristics, taken in isolation or in any technically feasible combination:

- the turbine body comprises a first end face and a second end face, the two end faces delimiting the body of the turbine along the common axis, the ratio between the gas flow rate passing through the second end face and the gas flow rate of the first part of the flow being less than 1/100.
- the turbine at least partially defines an auxiliary passage suitable for conveying a second part of the gas flow from the rotor to the bottom of the bowl.
- the turbine body is so designed that, in operation, the ratio between the flow rate of the first part of the gas flow and the second part of the gas flow is greater than or equal to 2, preferably greater than or equal to 3 and preferably greater than or equal to 10.
- the turbine body has a first end face delimiting the turbine body along the common axis, the skirt bearing against the first end face, each outlet duct extending between two ends, the turbine body delimiting each of the outlet ducts extending from one end to the other end, each outlet duct opening onto the first end face.
- the turbine body comprises a second end face delimiting the turbine body along the common axis, the injector being received in an opening made in the second end face, the opening having a first support face perpendicular to the common axis, the injector comprising a second support face, the second support face bearing against the first support face.

A fluid spraying device is also proposed, comprising a bowl, a turbine, the rotor being surrounded by the turbine body in a plane perpendicular to the common axis, the turbine body being designed to guide the rotor in rotation, an injector designed to inject the fluid into the bottom of the bowl, and a skirt at least partially surrounding the bowl in a plane perpendicular to the common axis and designed to eject jets of gas to shape the sprayed fluid.

According to advantageous but not mandatory embodiments, the fluid spraying device comprises one or more of the following characteristics, taken in isolation or in any technically feasible combination:

- an upstream direction and a downstream direction are defined for the common axis, the skirt being offset towards the downstream direction relative to the turbine body, the rotor having a first upstream face delimiting the rotor along the common axis, the turbine body delimiting a chamber for receiving the rotor, the chamber comprising a second upstream face delimiting the chamber along the common axis, the second upstream face facing the first upstream face and being offset in the upstream direction relative to the first upstream face, an annular groove centered on the common axis being formed in the second upstream face, the annular groove being designed to receive the gas flow and to transmit the first part of the gas flow to each outlet duct.
- the second upstream face comprises, for each outlet duct, a radial groove extending radially outwards from the annular groove and designed to guide the first part of the gas flow from the annular groove to the outlet duct.
- two outlet ducts, the radial grooves each extending from the annular groove in a straight line, the two lines being merged.
- an auxiliary passage suitable for conveying a second part of the gas flow from the rotor to the bottom of the bowl, at least a portion of the auxiliary passage being provided in the turbine body.
- the injector is surrounded by the rotor in a plane perpendicular to the common axis, a free volume separating the rotor and the injector in a plane perpendicular to the common axis, the auxiliary passage comprising a duct designed to guide the second part of the gas flow to the free volume, the free volume being suitable for guiding the second part of the gas flow to the bottom of the bowl.

An installation assembly is also proposed, comprising a movable arm and a fluid spraying device in which the turbine body is mounted directly on the arm.

BRIEF DESCRIPTION OF THE DRAWINGS

The characteristics and advantages of the invention will become apparent in light of the description which follows, given solely by way of non-limiting example, and made with reference to the accompanying drawings, in which.

DETAILED DESCRIPTION OF EMBODIMENTS

Figure 1:
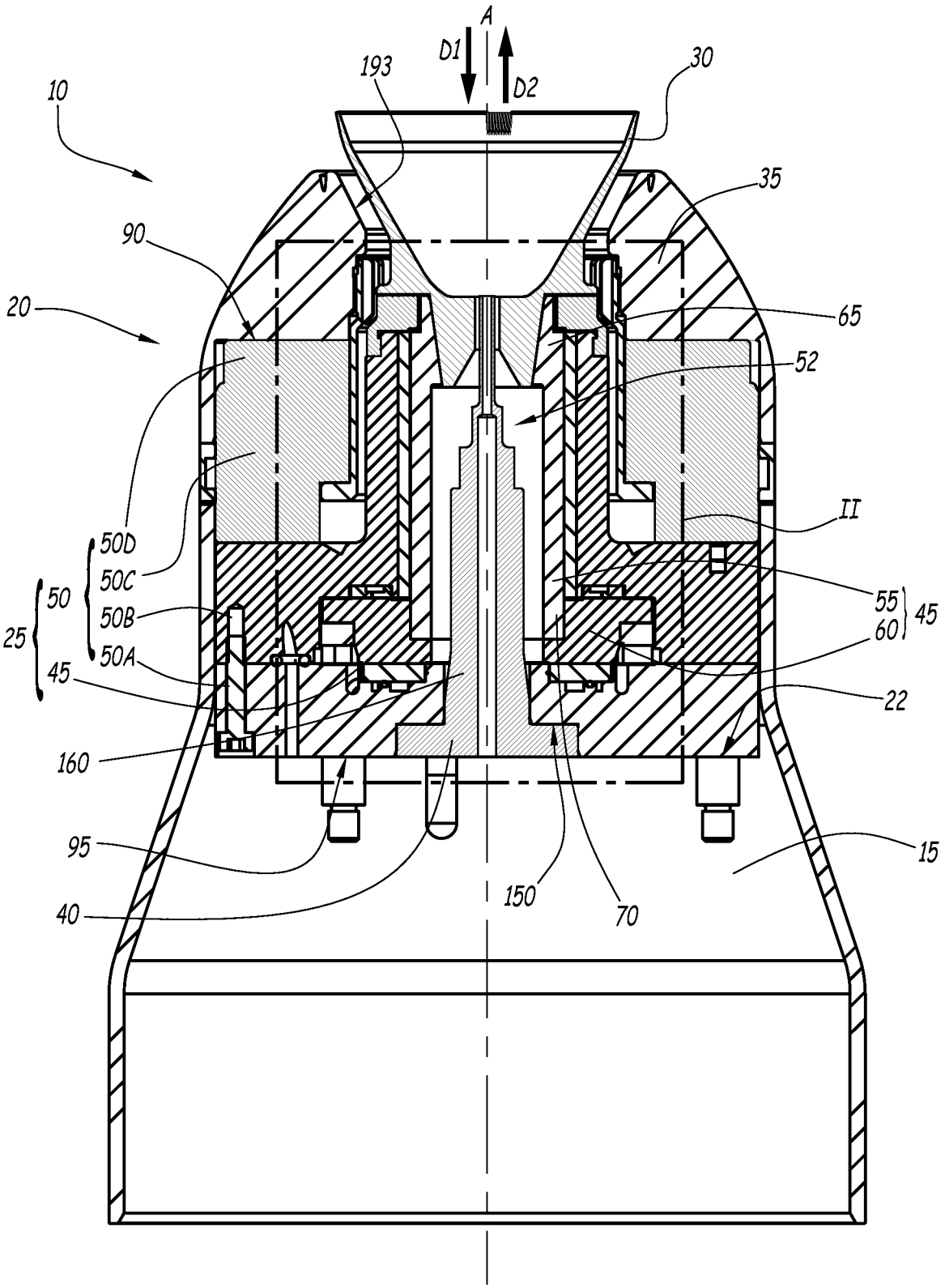
FIG. 1 is a sectional view of a fluid spraying device according to the invention, this device comprising a threaded tube and a turbine body comprising a flange.

A fluid spraying installation 10 is partially shown in FIG. 1.

The installation 10 is designed to spray a fluid F.

Figure 3:
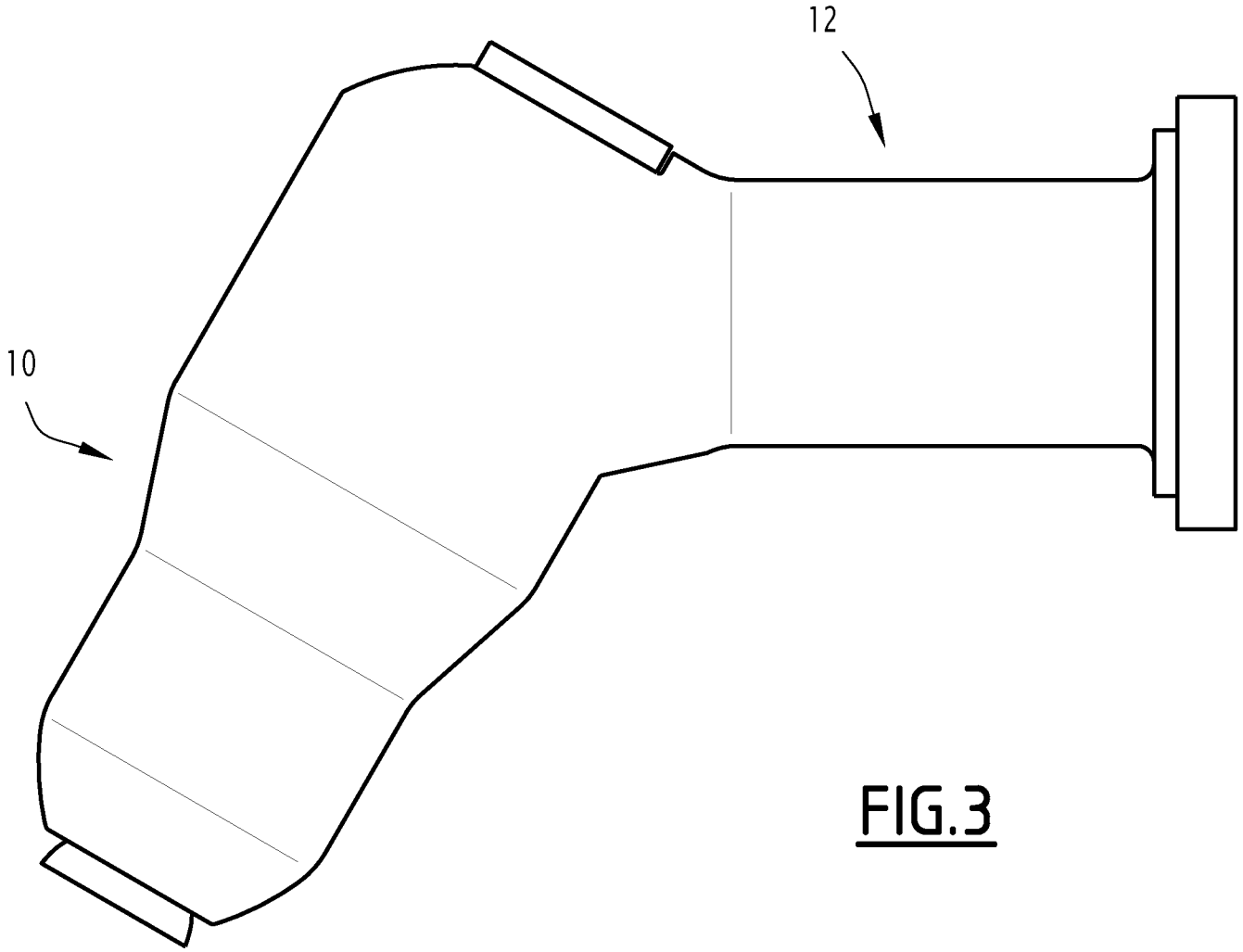
FIG. 3 is a perspective view of a fluid spraying device.

As shown in FIG. 3, the installation 10 is connected to a support 12 which fixes to a robot. The whole forms a "sprayer".

The installation 10 comprises a part 15 and a device 20 for spraying the fluid F.

The fluid F is, in particular, a coating product such as a paint or a varnish. For example, the fluid F may be a paint or a varnish intended to at least partially cover an automobile body panel.

Part 15 supports device 20. Part 15 is, in particular, designed to move the device 20 in space, in particular to orient the device 20 in a plurality of directions in space.

Part 15 is, for example, an articulated arm comprising actuators capable of pivoting the various segments of the arm 15 with respect to one another so as to move and orient the device 20 in space.

Part 15 is further provided for supplying device 20 with a voltage or an electric current, with at least one flow of gas G and with a flow of fluid F to be sprayed.

The gas G is, for example, air.

Part 15 has, for example, a substantially flat fixing face 22. The device 20 is mounted on the fixing face 22.

The fixing face 22 is, for example, crossed by a plurality of supply ducts of the part 15 with gas G and fluid F, and by electrical supply conductors of the device 20.

The device 20 is designed to project the fluid F. The device 20 comprises a turbine 25, a bowl 30, a skirt 35 and an injector 40.

The turbine 25 is designed to drive the bowl 30 in rotation about an axis A, called the "common axis". In particular, the turbine 25 is designed to receive from part 15 a first gas flow G and to drive the bowl 30 in rotation about the common axis A under the effect of the first gas flow G.

The turbine 25 comprises a rotor 45 and a body 50, also sometimes referred to as a "stator".

An upstream direction D1 and a downstream direction D2, shown in FIG. 1, are defined for the common axis A. The upstream direction D1 and the downstream direction D2 are collinear and opposite to each other.

The upstream direction D1 is such that the turbine 25 is offset with respect to the skirt in the upstream direction D1.

The downstream direction D2 is such that the skirt 35 is offset in the downstream direction D2 relative to the turbine 25.

The turbine 25 is interposed between the skirt 35 and the fixing face 22 of the part 15 along the common axis A. In particular, the fixing face 22, the turbine 25 and the skirt 35 are superimposed in this order in the direction downstream D2.

The rotor 45, the skirt 35 and the injector 40 are directly mounted on the turbine body 50.

In particular, "directly mounted" is understood to mean a relationship in which two parts are held in position relative to each other by contact between these two parts. For example, any relative translational movement of these two parts is prevented by the contact between these two parts. Two parts integral in translation but movable in rotation with respect to one another about the common axis are likely to be described as "directly mounted" on top of each other.

In particular, at least one face of each of the parts is in contact with the other part to ensure the fixing of the two parts to each other.

A first part screwed to a second part by a screw passing jointly through the first part and the second part is, for example, directly mounted on the second part if the two parts are in contact with each other.

On the contrary, two parts are not directly mounted on top of each other if they are not in contact with each other but are each fixed to a single other part.

In particular, when the rotor 45, the skirt 35 and the injector 40 are directly mounted on the turbine body 50, the turbine body 50 is suitable for allowing relative positioning of the rotor 45, the skirt 35 and the injector 40. In other words, the turbine body 50 maintains the rotor 45, the skirt 35 and the injector 40 in position with respect to each other.

Thus, the turbine body 50, the rotor 45, the skirt 35 and the injector 40 form a set of parts integral in translation with respect to one another.

In addition, the turbine body 50 has a suitable shape to allow the flow of air to the skirt 35.

The rotor 45 is directly mounted on the turbine body 50.

The rotor 45 is movable in rotation about the common axis A relative to the turbine body 50. The rotor 45 is, in particular, designed to be driven in rotation relative to the turbine body 50 by the first gas flow G.

The rotor 45 defines a first chamber 52 for receiving the injector 40.

The rotor 45 has a primary portion 55 and a secondary portion 60.

The first chamber 52 extends along the common axis A.

The first chamber 52 has, for example, a symmetry of revolution about the common axis A. In particular, the first chamber 52 is cylindrical about the common axis A.

A first internal diameter is defined for the first chamber 52. The first internal diameter is between 10 millimeters (mm) and 20 mm.

The first chamber 52 passes through the rotor 45 along the common axis A. In particular, the first chamber 52 passes through both the primary portion 55 and the secondary portion 60 along the common axis A.

The primary portion 55 is offset in the downstream direction D2 relative to the secondary portion 60. The primary portion 55 is delimited in the upstream direction D1 by the secondary portion 60.

The primary portion 55 has a first external diameter. The first external diameter is between 20 mm and 40 mm. The primary portion 55 is designed to drive the bowl 30 in rotation about the common axis A.

The primary portion 55 has a first downstream end 65 designed to interact with the bowl 30 to secure the primary portion 55 and the bowl 30, and a first upstream end 70 fixed to the secondary portion 60. Among the first downstream end 65 and the first upstream end 70, the first downstream end 65 is offset in the downstream direction D2 relative to the first upstream end 70.

The primary portion 55 has a cylindrical external face about the common axis A and able to interact with the turbine body 50 to guide the rotor 45 in rotation about the common axis A. The external face of the primary portion 55 delimits the primary portion in a plane perpendicular to the common axis A.

The secondary portion 60 has a first upstream face 75, a first side face 80 and a first downstream face 85.

The secondary portion 60 is delimited along the common axis A by the first upstream face 75 and by the first downstream face 85.

The first upstream face 75 is offset in the upstream direction D1 relative to the first downstream face 85.

The first upstream face 75 is perpendicular to the common axis A. The first upstream face 75 faces the upstream direction D1.

The first upstream face 75 is substantially flat.

The first upstream face 75 is crossed along the common axis by the first chamber 52.

The first upstream face 75 comprises, in a known manner, drive members 88 designed to drive the rotor 45 in rotation when the first gas flow G is directed onto the drive members 88.

The drive members 88 comprise, in particular, a set of blades.

Figure 2:
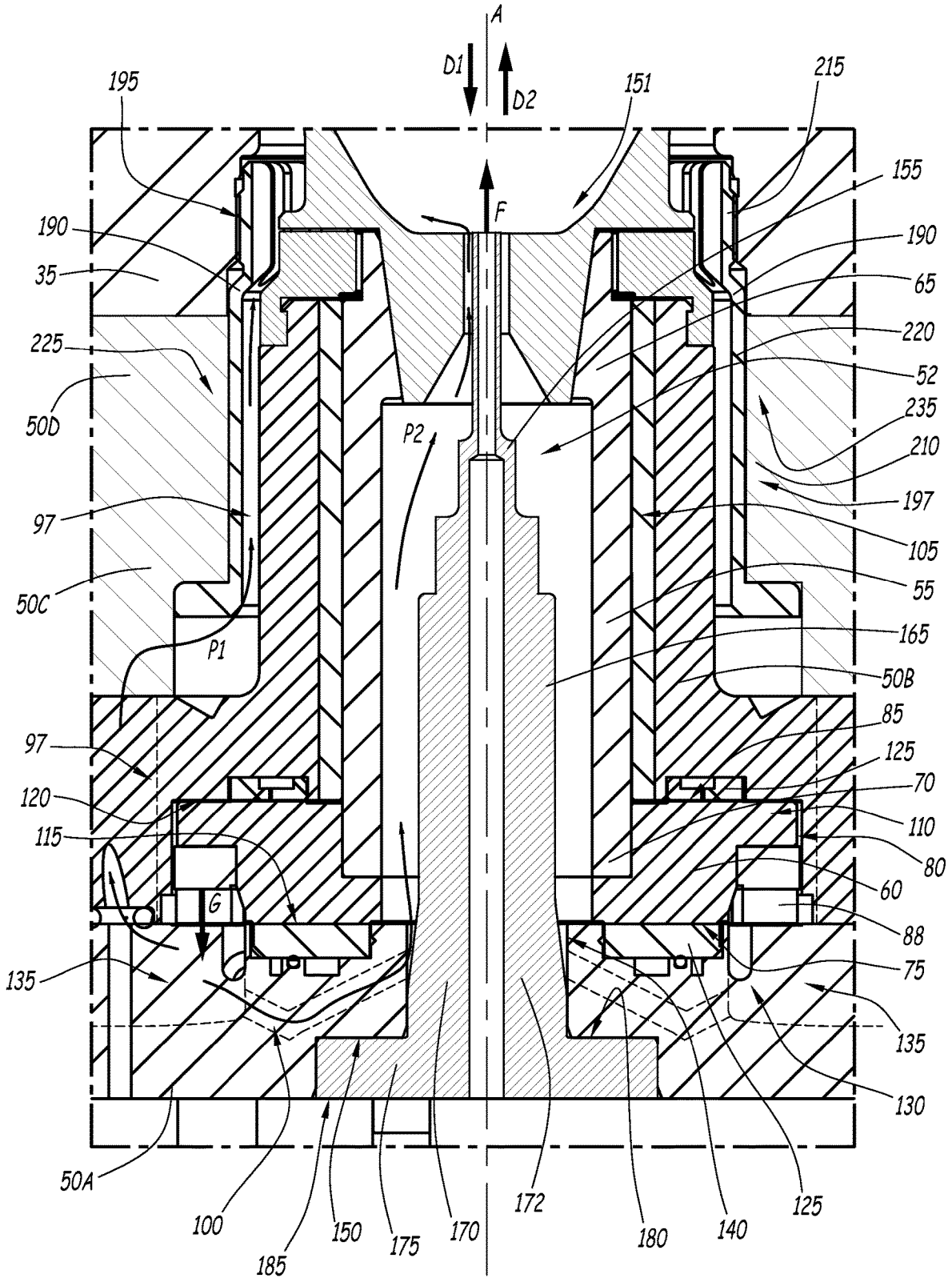
FIG. 2 is an enlarged view of the flange of FIG. 1.

According to the example of FIG. 2, the drive members 88 are arranged on a perimeter of the first upstream face 75.

The first side face 80 defines the secondary portion 60 in a plane perpendicular to the common axis 80.

The first side face 80 is cylindrical about the common axis A.

The first side face 80 has a second external diameter. The second external diameter is between 50 mm and 60 mm.

The first downstream face 85 surrounds the primary portion 55 in a plane perpendicular to the common axis A.

The first downstream face 85 faces the downstream direction D2.

The first downstream face 85 is substantially flat.

The turbine body 50 is mounted directly on the part 15. For example, the turbine body 50 is integral in rotation and in translation with the part 15.

In particular, the turbine body 50 is fixed to the fixing face 22 of the part 15, for example by a plurality of screws.

Thus, the rotor 45, the injector 40 and the skirt 35 are each mounted on the part 15 through the turbine body 50.

According to the example of the spraying device 20 shown in FIGS. 1 and 2, the turbine body 50 comprises a first part 50A, called flange 50A, a second part 50B, a third part 50C and a fourth part 50D.

It should be noted that the number and the arrangement of the different parts 50A to 50D making up the turbine body 50 are liable to vary. This is particularly the case for the third part 50C and the fourth part 50D.

The flange 50A, the second part 50B, the third part 50C and the fourth part 50D are aligned in this order along the common axis A, the flange 50A being offset in the upstream direction D1 relative to the second part 50B, which is offset in the upstream direction D1 relative to the third part 50C, which is itself offset in the upstream direction D1 relative to the fourth part 50D.

The flange 50A is interposed between the second part 50B and the fixing face 22.

The turbine body 50 has a first end face 90 and a second end face 95. The turbine body 50 is delimited along the common axis A by the first end face 90 and by the second end face 95.

The turbine body 50 is designed to receive the first flow of gas G from part 15, in particular through the fixing face 22, and to supply the rotor 45 with the first flow of gas G to drive the rotor 45 in rotation. For example, the turbine body 50 is designed to guide the first gas flow G to the drive members 88.

The turbine body 50 is also designed to receive the first gas flow G at the outlet of the rotor 45 and to guide the first gas flow G to the outside of the spraying device 20.

The turbine body 50 is further designed to guide a first part P1 of the first gas flow G received from the rotor 45 up to the skirt 35. For this, the turbine body 50 defines at least a first outlet duct 97. According to the example shown in FIG. 1, the turbine body 50 defines two such first outlet ducts 97.

The turbine body 50 is further designed to receive a second gas flow G from part 15 and to supply the skirt 35 with the second gas flow G without the second gas flow G driving the rotor 45 in rotation.

The turbine body 50 surrounds the rotor 45 in a plane perpendicular to the common axis A.

The turbine body 50 is designed to guide the rotor 45 in rotation.

The turbine body 50 defines a second chamber for receiving the rotor 45 and a third chamber 57 for receiving the injector 40.

The turbine body 50 is further designed to guide a second part P2 of the first gas flow G received from the rotor 45 to the second chamber. For this, the turbine body 50 defines at least one second outlet duct 100. According to the example shown in FIG. 1, the turbine body 50 defines two such second outlet ducts 100.

The first end face 90 is provided in the fourth part 50D.

The first end face 90 is offset in the downstream direction D2 relative to the second end face 95. The first end face 90 faces the downstream direction D2.

The second end face 95 is, in particular, formed in the flange 50A. In particular, the flange 50A is delimited by the second end face 95 along the common axis A.

The second end face 95 bears against the fixing face 22 of the part 15. The second end face 95 is substantially flat.

The second chamber has a bearing which is fixed and integral with the turbine body 50.

The bearing allows the injection and maintenance of a film of air with the rotor 45 to allow its rotation at high speed.

The second chamber also has an element capable of producing sounds detectable by a microphone, the air injection being specific. The element makes it possible to estimate the speed of the turbine 25.

The first cavity 105 and the second cavity 110 communicate with each other.

The first cavity 105 and the second cavity 110 are each cylindrical with a circular base about the common axis A.

The first cavity 105 is offset in the downstream direction D2 relative to the second cavity 110.

The first cavity 105 accommodates the primary portion 55 of the rotor 45.

The first cavity 105 is designed to guide the primary portion 55 of the rotor 45 in rotation.

The second cavity 110 houses the secondary portion 60 of the rotor 45.

The second cavity 110 is delimited along the common axis A by a second upstream face 115 and a second downstream face 120 of the turbine body 50.

The second cavity 110 is substantially cylindrical about the common axis A.

The secondary portion 60 of the rotor 45 is interposed between the second upstream face 115 and the second downstream face 120 along the common axis A. For example, the secondary portion 60 is gripped by the second upstream face 115 and the second downstream face 120.

The second upstream face 115 is, for example, provided in the flange 50A, which is shown alone in FIG. 3.

In particular, the flange 50A is delimited along the common axis A by the second end face 95 and by the second upstream face 115. The flange 50A is in particular traversed from the second end face 95 to the second upstream face 115 by a set of passages provided to allow the passage of electrical conductors, fluid flow F and gas flow G.

The second upstream face 115 is offset in the upstream direction D1 relative to the second downstream face 120.

The second upstream face 115 is opposite the first upstream face 75 of the rotor 45.

The second upstream face 115 comprises, for example guide members 125 suitable for allowing rotation of the rotor 45 by input to the turbine body 50. These guide members 125 are for example microperforated parts which make it possible to create an air film. The guide members 125 are, for example, housed in an annular channel 127 centered on the common axis and provided in the second upstream face 115.

The second upstream face 115 is perpendicular to the common axis A.

The second upstream face 115 comprises an annular groove 130 and at least one radial groove 135. For example, the second upstream face 115 comprises two radial grooves 135, one for each first outlet duct 97.

The annular groove 130 and the radial groove or grooves 135 is/are formed in the flange 50A.

The annular groove 130 is designed to collect the first gas flow G at the outlet of the rotor 45. In particular, the annular groove 130 is opposite the drive members 88.

The annular groove 130 is designed to transmit the first part P1 of each first gas flow G to each first outlet duct 97. In particular, the annular groove 130 is designed to transmit the first part P1 to each first outlet duct 97 via the corresponding radial groove 135.

The annular groove 130 is further designed to transmit each second part P2 of the first gas flow G received from the rotor 45 to the corresponding second outlet duct 100.

The annular groove 130 is centered on the common axis A. In particular, the annular groove 130 is delimited by two cylindrical faces about the common axis A of the turbine body 50.

The annular groove 130 has an external diameter of between 40 mm and 45 mm. The annular groove 130 has an internal diameter of between 45 mm and 50 mm.

The annular groove 130 has a depth, measured along the common axis A, of between 1 mm and 10 mm.

Each radial groove 135 extends along a specific straight line L1 contained in a plane perpendicular to the common axis A and is concurrent with the common axis A. The specific lines L1 of the radial grooves 135 are, for example, coincident with one another. In other words, the radial grooves 135 are diametrically opposed.

Each radial groove 135 extends radially outwards from the annular groove 130. The annular groove 130 is, in particular, interposed between the two radial grooves 135.

Each radial groove 135 opens into the annular groove 130.

Each radial groove 135 has a length, measured from the annular groove 130 along the specific line L1, between 15 mm and 20 mm.

Each radial groove 135 has a width, measured in a plane perpendicular to the common axis A and in a direction perpendicular to the specific line L1, between 10 mm and 18 mm.

Each radial groove 135 has a depth, measured along the common axis A, of between 5 mm and 15 mm. The depth of the radial groove 135 is, for example, equal to the depth of the annular groove 130.

The second downstream face 120 is perpendicular to the common axis A. The second downstream face 120 is opposite the second upstream face 115.

The second downstream face 120 is substantially flat.

The second downstream face 120 is suitable for preventing a displacement of the rotor 45 in the downstream direction D2 relative to the turbine body 50.

The second downstream face 120 bears against the first downstream face 85, for example by means of the guide members 125.

Each first outlet duct 97 is, for example, jointly delimited by the second part 50B, the third part 50C and the fourth part 50D. In particular, each first outlet duct 97 comprises a plurality of portions opening into one another, these portions each being delimited by one of the second part 50B, the third part 50C and the fourth part 50D.

Each first outlet duct 97 is designed to conduct a first part P1 of the first gas flow G from the annular groove 130 to the skirt 35.

In particular, each first outlet duct 97 opens onto the first end face 90, which is opposite the skirt 35. According to the embodiment shown in FIGS. 1 and 2, each first outlet duct 97 is designed to lead the first corresponding part P1 into the free space separating the bowl 30 from the skirt 35.

Each first outlet duct 97 opens into the corresponding radial groove 135.

Each first outlet duct 97 is entirely delimited by the turbine body 50. In other words, each first outlet duct 97 is provided in the turbine body 50 and only in the latter. The first part P1 circulating in the first outlet duct 97 is therefore only in contact with the turbine body 50 while the first part P1 circulates in the first outlet duct 97.

Each first outlet duct 97 therefore forms, with the corresponding radial groove 135 and with the annular groove 130, a passage connecting the rotor 45 to the first end face 90. This passage is entirely delimited by the turbine body 50.

Each second outlet duct 100 is, for example, provided in the flange 50A.

Each second outlet duct 100 is designed to transmit a second part P2 of the first gas flow G from the annular groove 130 to the third chamber 57.

Each second outlet duct 100 is entirely delimited by the turbine body 50. In other words, each second outlet duct 100 is provided in the turbine body 50 and only in the latter. The second part P2 circulating in the second outlet duct 100 is therefore only in contact with the turbine body 50 while the second part P2 circulates in the second outlet duct 100.

Each second outlet duct 100 therefore forms, with the annular groove 130, a passage connecting the rotor 45 to the third chamber 57. This passage is entirely delimited by the turbine body 50.

The third chamber 57 is provided in the flange 50A.

The third chamber 57 is designed to partially house the injector 40.

The third chamber 57 is offset in the upstream direction D1 relative to the second chamber.

The third chamber 57 opens onto the second end face 95 and the second upstream face 115. The third chamber 57 therefore communicates with the second chamber, in particular with the second cavity 110 of the second chamber.

The third chamber 57 has a third cavity 140 and a fourth cavity 145.

The third cavity 140 and the fourth cavity 145 are each cylindrical about the common axis A.

The third cavity 140 is interposed between the fourth cavity 145 and the second cavity 110.

The third cavity 140 has a diameter of between 12 mm and 15 mm. The third cavity 140 has a length, measured along the common axis A, of between 10 mm and 30 mm. Each second outlet duct 100 opens into the third cavity 140.

The first support face 150 is annular, and centered on the common axis A. The first support face 150 is substantially flat. The first support face 150 is perpendicular to the common axis A.

The first support face 150 delimits the fourth cavity 145 in the downstream direction D2.

The first support face 150 is designed to come to bear against the injector 40 to prevent the injector 40 from moving in the downstream direction D2 relative to the turbine body 50.

The bowl 30 is directly mounted on the rotor 45. In particular, the bowl 30 is fixed to the first upstream end 65 of the primary portion 55 of the rotor 45. The rotor 45 is then interposed between the bowl 30 and the second upstream face 115 along the common axis A.

The bowl 30 is designed to be driven in rotation about the common axis A by the rotor to generate the flow of fluid F to be sprayed.

The bowl 30 is designed to receive the fluid F to be sprayed from the injector 40 at the bottom 151 of the bowl 30.

The bowl 30 protrudes from the skirt 35 in the downstream direction D2.

The skirt 35 is designed to generate a set of jets of gas G, these jets being designed to shape the fluid F sprayed. For example, the skirt 35 is designed to receive the first stream and the second stream of gas G and to generate the jets of gas G from the first and second streams received.

The skirt 35 surrounds the bowl 30 in a plane perpendicular to the common axis A. The skirt 35 in particular defines an opening 152 for receiving the bowl 30. This opening 152 opens onto the face of the skirt which defines the skirt 35 in the downstream direction D2.

The skirt 35 bears against the first end face 90 of the turbine body 50. The turbine body 90 is interposed, along the common axis A, between the fixing face 20 of the part 15 and the skirt 35.

The skirt 35 is fixed to the turbine body 50 so as to eliminate all the degrees of freedom between the turbine body and the skirt 50.

The injector 40 is designed to inject the flow of fluid F to be sprayed into the bottom 151 of the bowl 30.

The injector 40 is directly mounted on the turbine body 50. In particular, the injector is received at least partially in the third chamber 57.

The injector 40 is designed so that, when the injector 40 is received in the third chamber 57, a relative translational movement of the injector 40 with respect to the turbine body 50 in a plane perpendicular to the common axis A is stopped.

Optionally, the injector 40 is further fixed to the turbine body 50 by fixing means such as screws to prevent respective rotation of the injector 40 and of the turbine body 50 about the common axis A, and/or to prevent a relative translation of these two parts along the common axis A.

The injector 40 is received in the first chamber 52 formed in the rotor 45.

The injector 40 is designed to allow relative rotational movement about the common axis A between the rotor 45 and the injector 40. In particular, the injector 40 is not in contact with the walls of the rotor 45 which delimit the first chamber 52.

The rotor 45 and the injector 40 define a free volume, which corresponds to the portion of the first chamber 52 which is complementary to the injector 40.

The injector 40 has an injection member 155 and an injector body 160.

The injector 40 is designed so that the free volume is in communication with the bottom 151 of the bowl 30. For example, the injection member 155 is received in a cavity of the bowl 30 opening into the bottom 151 of the bowl 30, and has an external diameter distinctly inside the internal diameter of this cavity, so that a gas, in particular gas G, is able to circulate from the free volume to the bottom 151 of the bowl 30 in the gap between the walls of this cavity and the injection member 155.

Further, the injector 40 is designed so that every second outlet duct 100 is in communication with the free space. Thus, the second outlet duct 100 and the free space form an auxiliary duct suitable for transmitting the second part P2 of the first gas flow G from the annular groove 130 to the bottom 151 of the bowl 30.

The injection member 155 is designed to inject the flow of fluid F to be sprayed into the bottom 151 of the bowl 30.

The injection member 155 is offset in the second direction D2 relative to the injector body 160.

The injector body 160 is designed to receive the flow of fluid to be sprayed F from part 15, and to transmit the flow of fluid to be sprayed F to the injector 155.

The injector body 160 has a third portion 165, a fourth portion 170, a fifth portion 172, and a flange 175.

The third portion 165, the fourth portion 170, the fifth portion 172 and the flange 175 are offset in this order with respect to each other in the upstream direction D1.

The injection member 155 is mounted on the third portion 165.

The third portion 165 is cylindrical about the common axis A. The third portion 165 is delimited along the common axis by the injection member 155 and by the fifth portion 172.

The diameter of the third portion 165 is between 5 mm and 15 mm.

The fourth portion 170 is delimited along the common axis A by the collar 175 and by the fifth portion 172.

The fourth portion 170 is received in the third cavity 140.

The fourth portion 170 is cylindrical about the common axis A.

The diameter of the fourth portion 170 is distinctly greater than the diameter of the third portion 165.

The fourth portion 170 has a length, measured along the common axis, distinctly less than the distance between the end of each second duct 100 and the fourth cavity 145, so that each second duct 100 opens into the third cavity 140 opposite the fifth portion 172.

The fifth portion 172 is interposed along the common axis A between the third portion 135 and the fourth portion 170.

The fifth portion 172 is delimited along the common axis A by the third portion 135 and the fourth portion 170.

The fifth portion 172 is in the form of a truncated cone centered on the common axis A. The diameter of the fifth portion 172 decreases from one end delimited by the fourth portion 170 to another end delimited by the third portion 165.

In particular, facing the end of each second outlet duct 100 which opens into the third cavity 140, the diameter of the fifth portion 172 is distinctly less than the diameter of this third cavity.

In this way, the second part P2 of the first gas stream G is capable of being delivered through the second outlet duct 100 into the free volume.

The collar 175 is cylindrical about the common axis A.

The collar 175 has a thickness, measured along the common axis, substantially equal to the length of the fourth cavity 145.

The diameter of the flange 175 is substantially equal to the diameter of the fourth cavity 180. The flange 175 has a second support face 180 and a third support face 185. The flange 175 is delimited along the common axis A by the second and third support faces 180 and 185. The thickness of the collar 175 is measured between the second and third support faces 180 and 185.

The second support face 180 is perpendicular to the common axis A.

The second support face 180 bears against the first support face 150. Thus, a translation of the injector 40 in the downstream direction D2 relative to the turbine body 50 is prevented.

The third support face 180 is, for example, in abutment against the fixing face 22 of the part 15 when the spraying device 20 is fixed by the part 15, so that the flange 75 is clamped between the fixing face 22 and the first support face 150 formed in the turbine body 50. In particular, the third support face 180 and the second end face 95 are coplanar.

It should be noted that in certain embodiments envisaged, the thickness of the collar 175 is distinctly less than the length of the fourth cavity 145, so that the third support face 180 does not bear against the fixing face 22.

A method of manufacturing the installation 10 will now be described.

In a first step, the rotor 45, the skirt 35 and the injector 40 are mounted directly on the turbine body 50.

For example, the second, third and fourth pieces 50B, 50C and 50D are attached to each other. The rotor 45 is then inserted into the second chamber by a translation in the downstream direction D2, then the flange 50A is fixed to the second part 50B to grip the secondary portion 60 of the rotor 45. The rotor 45 is therefore fixed to the turbine body 50 by a mechanical connection allowing a single degree of freedom, which is a rotation along the common axis A.

The injector 40 is inserted into the second and third chambers 52, 57 by a translational movement in the downstream direction D2 until the second support face 180 is pressed against the first support face 150. The injector 40 is then fixed to the turbine body by a mechanical connection allowing only a relative translation in the upstream direction D1 between these two parts, and optionally a relative rotation about the common axis A.

Optionally, the injector 40 may also be fixed to the turbine body 50 by fasteners so as to eliminate all the degrees of freedom remaining between these two parts.

The skirt 35 is then positioned against the turbine body 50 so that the skirt 35 bears against the first end face 90. The skirt 35 is fixed to the turbine body 50 so as to eliminate all degrees of freedom between the skirt 35 and the turbine body 50.

Thus, at the end of the first step, an assembly is obtained comprising the turbine body 50, the rotor 45, the skirt 35 and the injector 40. The various elements of this assembly are integral in translation with one another.

In a second step, the bowl 30 is mounted on the rotor 45 to form the spraying device 20.

The third step is implemented after the first step.

In a third step, the assembly comprising the turbine body 50, the rotor 45, the skirt 35 and the injector 40 is mounted on part 15.

In particular, the turbine body 50 is mounted directly on part 15, for example by resting the second end face 95 against the fixing face 22 and by screws jointly passing through part and the body of the turbine 50. Thus, the turbine body 50 and the part 15 form a mechanical connection eliminating all the degrees of freedom between the turbine body 50 and the part 15.

According to one embodiment, the third step is implemented after the second step. For example, the spraying device 20, further comprising the bowl 30 is fixed to the part 15.

Since the rotor 45, the skirt 35 and the injector 40 are all directly mounted on the turbine body 50, the relative positioning of these parts is improved. Likewise, the precision of the positioning of the skirt 35 and of the injector 40 relative to the bowl 30 is improved, in particular compared to known devices where the skirt 35 and the injector 40 are attached to the part 15 and not to the turbine body 50. In fact, the number of parts involved in the positioning of the bowl 30 relative to the skirt 35 and to the injector 40 is reduced, since only the turbine body 50 and the rotor 45 connect the bowl 30 to the skirt 35 and to the injector 40.

The improvement in the positioning of the bowl 30 relative to the skirt 35 and to the injector 40 allows better control of the shaping of the sprayed fluid F, since the gas jets G to shape the fluid jet F are better positioned relative to the bowl 30.

Furthermore, the replacement of the spraying device 20 is made faster since it is possible to pre-mount the rotor 45, the skirt 35 and the injector 40 on the turbine body 50, and to pre-mount the bowl 30 on the rotor 45, before fixing the device 20 thus obtained in a simple manner on part 15, by only fixing the turbine body 50 to part 15.

The presence of the first duct 97 makes it possible to inject the first part P1 of the first flow G between the bowl 30 and the skirt 35, this air serving as compensation air to fill the depression under the bowl linked to the rotation of the bowl and to the injection of the airs of skirts.

This allows the air to be diverted directly into the turbine. This results in better delayed differentiation across all different sprayer bodies. In addition, avoiding grooves in the plastic body gives more solidity to the latter and allows positioning and inclinations of larger holes, therefore more space in smaller bodies. It also avoids very cold exhaust air in an area where metal inserts intermingle to cause high tension and plastic with all the stresses associated with the different expansions of the materials.

More specifically, the flow of cold air circulating internally in the turbine, the flow of cold air whose temperature may be as low as −40° C. does not come into contact with an interface between plastic and metal elements. In fact, since the two materials have different coefficients of expansion, exposure to cold air could lead to sealing problems.

Also, notwithstanding the fact that the use of a metal impeller as a reference allows a gain in precision, the shaping chosen for the impeller also makes it possible to improve the durability of the seal in the sprayer.

The auxiliary passage makes it possible to inject the second part P2 into the bottom 151 of the bowl 30 and thus to fill a depression which could be caused there by the rotation of the bowl 30.

Moreover, the part 15 and in particular the fixing face 22 are simplified when the ducts 97 and 100 are formed in the turbine body 50, since it is the turbine body 50 which receives the first gas flow G at the outlet of the rotor 45. It is therefore not necessary to shape the fixing face 22 to receive and discharge the first gas flow G at the outlet of the rotor.

In addition, the relative positioning of the injector 40 relative to the turbine body 50 is better controlled. This results in improved control of the distribution of the first gas flow G, at the outlet of the rotor 45, between the first part P1 and the second part P2.

According to some embodiments, the turbine body 25 is arranged so that, in operation, the ratio between the flow rate of the first part P1 of the gas flow and the second part P2 of the gas flow is greater than or equal to 2, preferably greater than or equal to 3 and preferably greater than or equal to 10. Such an effect is obtained in particular by a judicious choice of the size of the outlet duct 97 and of the size of the auxiliary passage.

The annular groove 130 allows a collection of the first gas flow G at the outlet of the rotor 45 with a very small axial size. The dimensions of the spraying device 20 are therefore reduced.

The radial grooves 135 make it possible to recover more and more exhaust air without recompressing it so as not to slow down the turbine 25. When the radial grooves 135 are diametrically opposed to each other, the first parts P1 of the flows of gases G collected by the ducts 97 are equal. The flow of gas G injected between the skirt 35 and the bowl 30 is then more spatially homogeneous.

The abutment of the first and second support faces 150 and 180 allows precise and simple positioning of the injector 40 relative to the turbine body 50.

In order to simplify the description of the first example above, it has not been detailed how the skirt 35 is fixed to the turbine body 50 after the skirt 35 has been brought to bear against the first end face 90.

Numerous fixing means are likely to be used to eliminate all the degrees of freedom between the skirt 35 and the turbine body 50, for example screws jointly passing through the skirt 35 and the turbine body 50. It should be noted that other means are likely to be used to mount the skirt 35 directly on the turbine body 50. For example, the skirt 35 and the turbine body 50 have screw threads complementary to each other to allow screwing of the skirt 35 on the turbine body 50.

Figure 4:
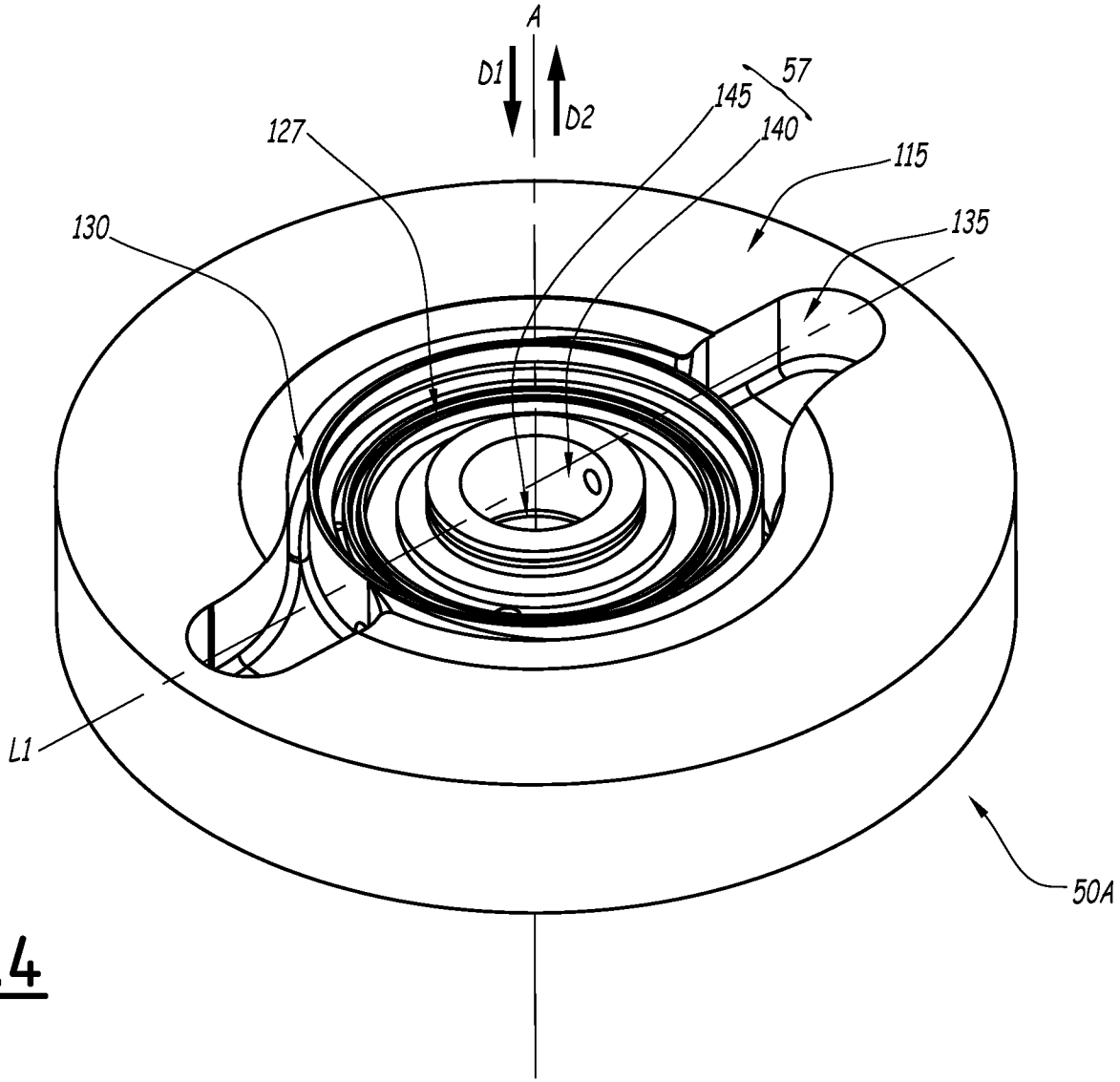
FIG. 4 is a perspective view of the flange of FIG. 1.
Figure 5:
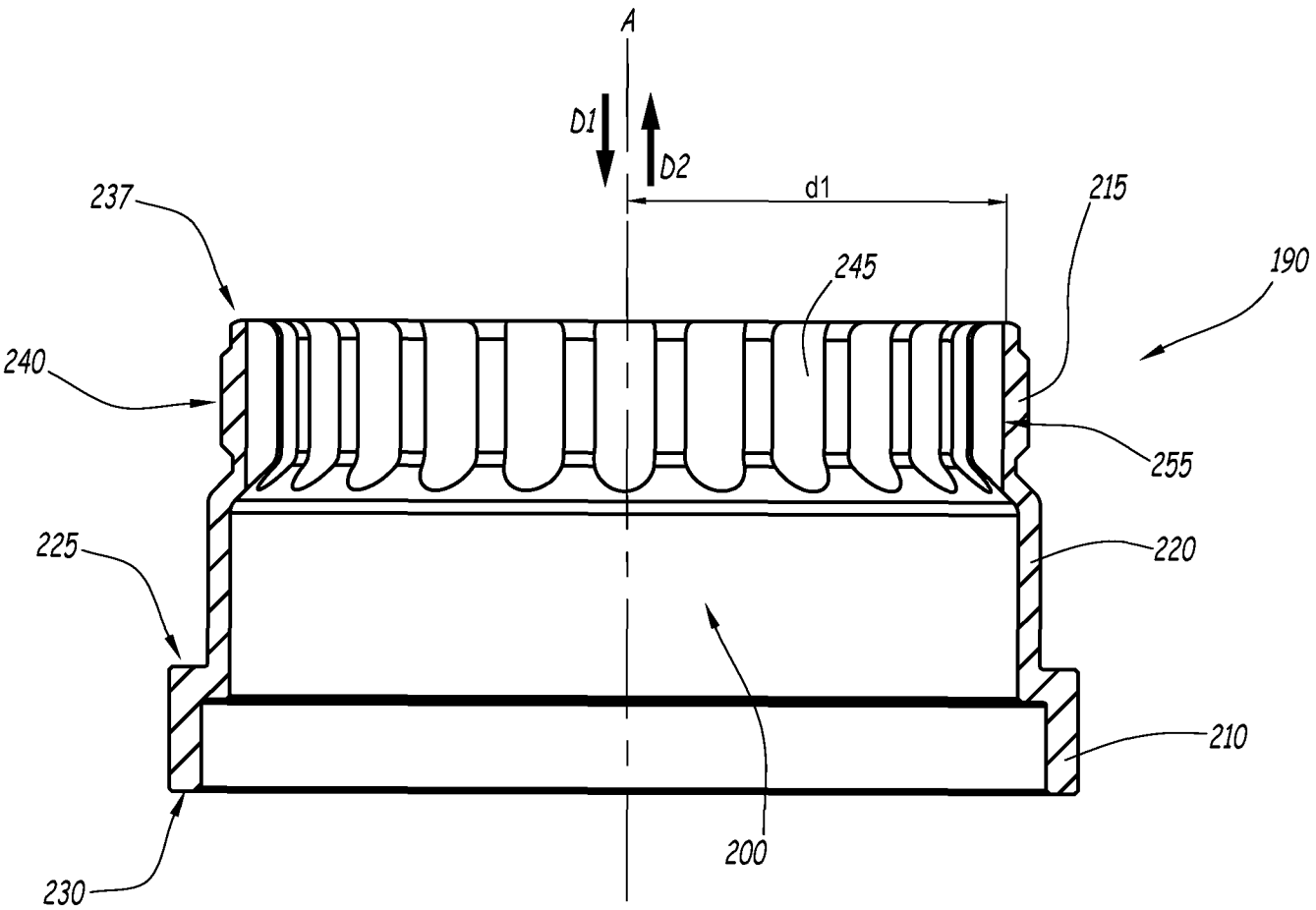
FIG. 5 is a sectional view of the threaded tube of FIG. 1.

According to the particular embodiment shown in FIGS. 1 and 2, the fluid spraying device 20 further comprises a threaded tube 190, visible in particular in FIG. 2 and shown separately in FIGS. 4 and 5.

The skirt 35 has an internal face 193. The internal face 193 of the skirt 35 is the face of the skirt 35 which surrounds the bowl 30 and which is opposite the bowl 30. In particular, the internal face 193 defines the opening 152 in which the bowl 30 is received.

The internal face 193 has a symmetry of revolution about the common axis A.

A minimum diameter is defined for the internal face 193 of the skirt 35. The minimum diameter is measured in a plane perpendicular to the common axis A between the two diametrically opposed points of the internal face 193 which are closest to one another.

The internal face 193 has a screw thread 195. The thread 195 surrounds the bowl in a plane perpendicular to the common axis A.

The threaded tube 190 is sometimes also referred to as a "nut" or even a "loose nut". The threaded tube 190 is mounted coaxially with the skirt 35 and the turbine body 50.

In particular, the threaded tube 190 is centered on the common axis A.

The threaded tube 190 is mounted directly on the turbine body 50. In particular, the threaded tube 190 is integral with the turbine body 50 in translation.

According to one embodiment, the turbine body 50 delimits an annular groove 197 receiving at least a portion of the threaded tube 190 and has faces capable of preventing relative translation of the threaded tube 190 and of the turbine body 50.

The annular groove 197 is, for example, formed in the third part 50C and extends along the common axis A from a downstream face of the third part 50C, this downstream face delimiting the third part in the downstream direction D2.

The threaded tube 190 is movable in rotation about the common axis A relative to the turbine body 50.

The threaded tube 190 is, for example, made of steel.

The threaded tube 190 has a symmetry of revolution about the common axis A.

The threaded tube 190 has an internal face 200 and an external face 205. The threaded tube 190 is delimited by the internal face 200 and by the external face 205 in a plane perpendicular to the common axis A.

The threaded tube 190 comprises at least a primary portion 210 and a secondary portion 215. According to the example of FIG. 4, the threaded tube 190 further comprises a tertiary portion 220 interposed between the primary portion 215 and the secondary portion 215. along the common axis A.

The primary portion 210 is offset in the upstream direction D1 relative to the tertiary portion 220.

The primary portion 210 is in the form of a cylinder with an annular base. In other words, the primary portion 210 is delimited by two cylindrical surfaces each centered on the common axis A. The primary portion 210 is in particular delimited by these two surfaces in a plane perpendicular to the common axis A.

The primary portion 210 has a third downstream face 225 and a third upstream face 230.

The primary portion 210 is surrounded by the turbine body 50 in a plane perpendicular to the common axis A. The primary portion 210 is in particular received in the opening 152.

The primary portion 210 is housed in the annular groove 197. In particular, the faces of the turbine body 50 which define the annular groove 197 in a plane perpendicular to the common axis A are designed to prevent translation of the threaded tube 190 with respect to the turbine body 50 in a plane perpendicular to the common axis A.

The primary portion 210 has an external diameter of between 45 mm and 60 mm.

The primary portion 210 has an internal diameter of between 40 mm and 55 mm.

The primary portion 210 is delimited in the downstream direction D2 by the third downstream face 225. The third downstream face 225 is perpendicular to the common axis A. The third downstream face 225 faces the downstream direction D2.

The third downstream face 225 surrounds the tertiary portion 220 in a plane perpendicular to the common axis A. The third downstream face 225 therefore forms a shoulder, since the outer diameter of the tertiary portion 220 is distinctly less than the outer diameter of the primary portion 210.

The primary portion 210 has a length, measured along the common axis A from the third downstream face 225, of between 5 mm and 20 mm. In particular, the length of the primary portion 210 is greater than or equal to 40 mm.

The third downstream face 225 bears against a face 235 of the turbine body 50 to prevent translation of the threaded tube 190 relative to the turbine body 50 in the downstream direction D2.

The face 235 is, for example, perpendicular to the common axis A. The face 235 faces the upstream direction D1. The face 235 is, for example, provided in the fourth part 50D. The face 235 is, along the common axis A, facing the annular groove 197. Thus, the face 235 defines the annular groove 197 along the common axis A, in particular along the downstream direction D2.

The secondary portion 215 is offset in the upstream direction D1 relative to the tertiary portion 220.

The secondary portion 215 is in the form of a cylinder with an annular base.

The secondary portion 215 is surrounded by the skirt 35 in a plane perpendicular to the common axis A. For example, the secondary portion 215 surrounds the bowl 30 in a plane perpendicular to the common axis A. The secondary portion 215 is therefore interposed coaxially between the skirt 35 and the bowl 30.

The secondary portion 215 has an external diameter of between 40 mm and 60 mm.

The secondary portion 215 has an internal diameter of between 30 mm and 55 mm.

The secondary portion 215 has a length, measured along the common axis A, of between 5 mm and 20 mm.

The secondary portion 215 has a third end face 237 delimiting the secondary portion 215 along the common axis A. The third end face 237 is perpendicular to the common axis A. The third end face 237 delimits in particular the secondary portion 215 in the downstream direction D2. The third end face 237 therefore faces the downstream direction D2.

The secondary portion 215 has, on its external face 205, a thread 240 designed to engage the thread 195 of the internal face 193 of the skirt 35 in order to exert on the skirt 35 a force tending to move the skirt 35, relative to the threaded tube 190, in the upstream direction D1.

Thus, since the third downstream face 225 bears against the face 235 of the turbine body 50 to prevent translation of the threaded tube towards the downstream direction D1 relative to the turbine body 50, a force tending to bring the skirt 35 closer to the turbine body 50 along the common axis and therefore to press the skirt 35 against the turbine body 50 is exerted by the tube 190 when the two threads 195 and 240 are engaged with one another.

The internal face 200 of the secondary portion 215 is designed to interact with a tool 250 for the transmission of a force tending to set the threaded tube 190 in rotation about the common axis A. In particular, the internal face 200 of the secondary portion 215 does not have a symmetry of revolution about the common axis A.

The internal face 200 of the secondary portion 215 has, at at least one point P, a normal direction $D_T$ perpendicular at this point to the internal face 200, an angle $\alpha$ between this normal direction and a segment $D_R$ connecting this point to the common axis A being distinctly greater than degrees. The angle $\alpha$ is measured in a plane perpendicular to the common axis A.

In other words, the inner face 200 of the secondary portion 215 moves at least 5 degrees away from a cylindrical surface about the common axis A at at least one point.

For example, at least one notch 245 is made in the internal face 200 of the secondary portion 215. According to the example shown in FIGS. 4 to 6, a plurality of notches 245 is formed in the internal face 200 of the secondary portion 215, in particular 25 notches 245. It should be noted that the number of notches 245 is likely to vary.

Figure 6:
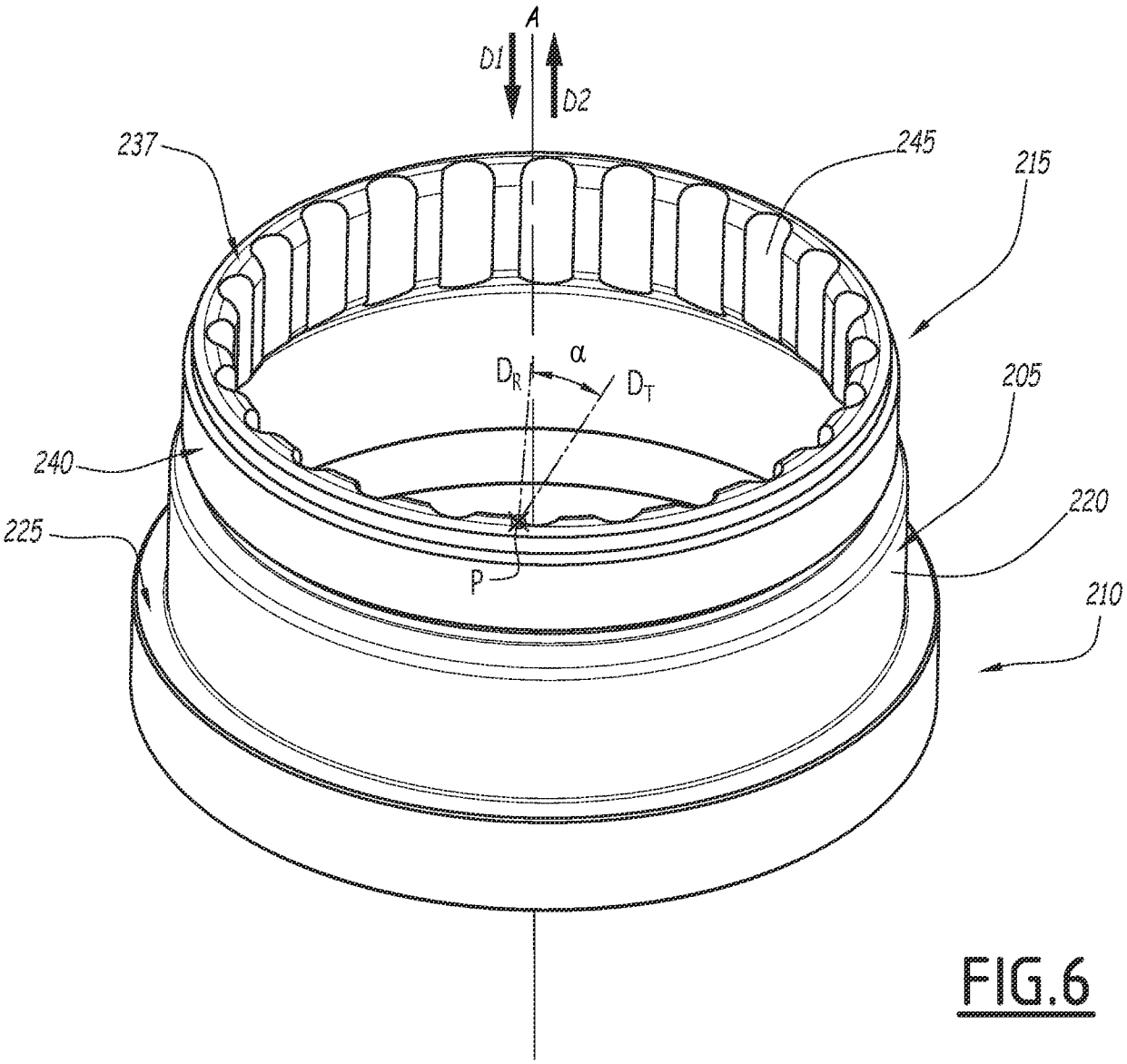
FIG. 6 is a perspective view of the threaded tube of FIG. 5.

The spraying device 20 is shown in FIG. 6, in a configuration where the bowl 30 has been removed from the spraying device 20. The notches 245 are then visible at the bottom of the opening 152 delimited by the skirt 35.

Each notch 245 opens onto the third end face 237.

Each notch 245 extends in a direction parallel to the common axis A. In particular, each notch 245 extends from the third end face 237.

Thus, a tool is capable of being inserted into the notches 245 from the third end face 237 by a translation in the upstream direction D1.

Each notch 245 has a uniform section along the common axis A. In particular, the shape and dimensions of each notch 245 are invariant by translation in a direction parallel to the common axis A along the notch 245.

Each notch 245 has, for example, an arcuate section in a plane perpendicular to the common axis A.

Each notch 245 has a depth of between 0.5 mm and 3 mm.

Each notch 245 has a bottom 255. The bottom 255 is the set of points of the notch 245 arranged at a distance, measured between the point in question and the common axis A in a plane perpendicular to the common axis A, distinctly greater than the distances from all other points.

When the notch 245 has an arcuate section, the bottom 255 is a line extending in a direction parallel to the common axis A.

Each point of the bottom 255 of each notch 245 is arranged at a distance dl from the common axis A, the distance dl being less than or equal to half the minimum diameter of the internal face of the skirt 35.

The tertiary portion 220 is cylindrical with an annular base. The tertiary portion 220 connects the primary portion 210 to the secondary portion 215.

The secondary portion 220 is, in particular, interposed in a plane perpendicular to the common axis A between the second part 50B and a fourth part 50D.

The tool 250 is designed to engage the internal face 200 of the secondary portion 215 to drive the threaded tube 190 in rotation about the common axis A. The tool 250 is in particular designed to transmit to the threaded tube 190 a force tending to rotate the tube 190 about the common axis A relative to the turbine body 50.

In particular, tool 250 is designed to engage notch(es) 245 to transmit rotational force to the threaded tube 190.

Figure 7:
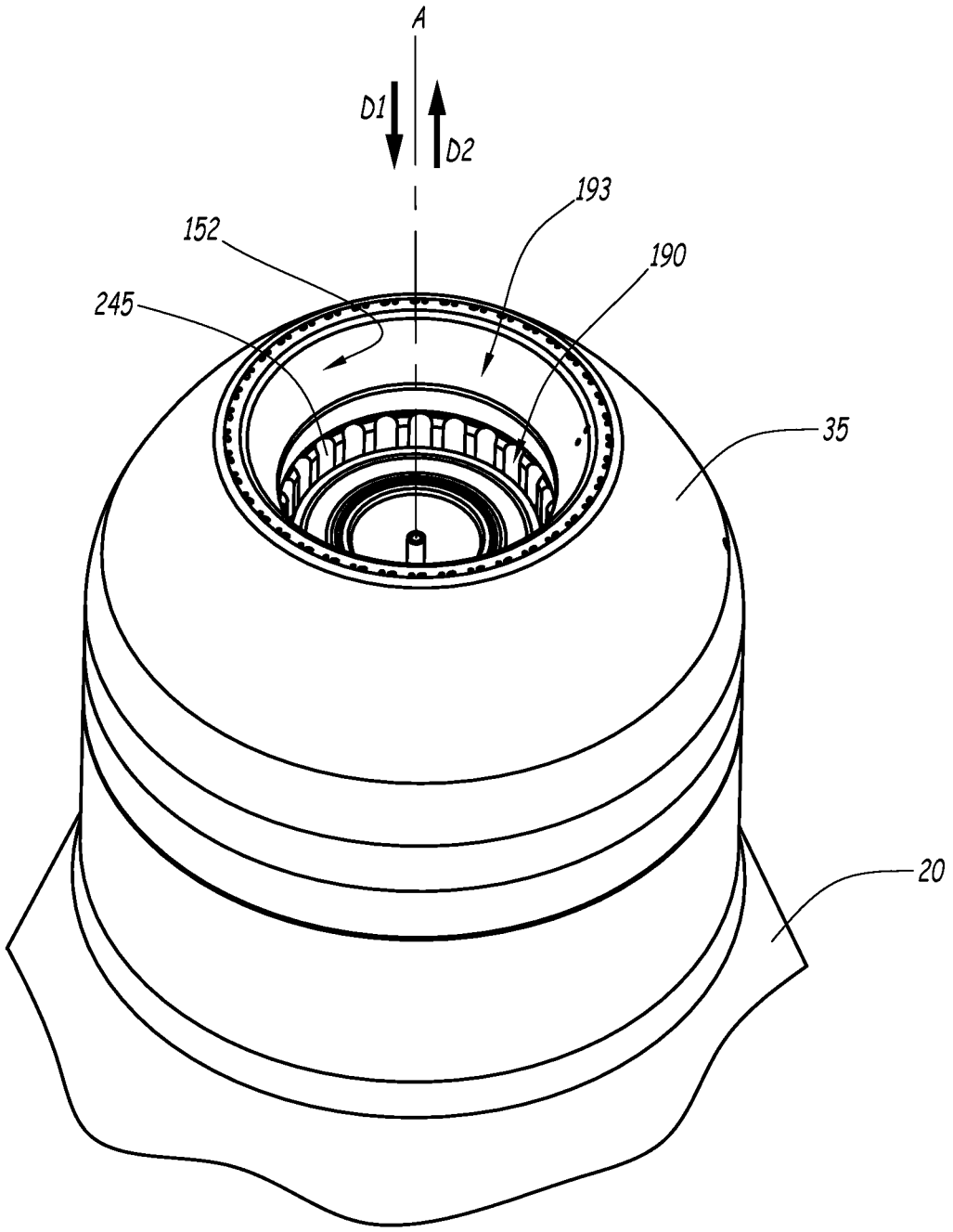
FIG. 7 is a perspective view of the spraying device of FIG. 1.
Figure 8:
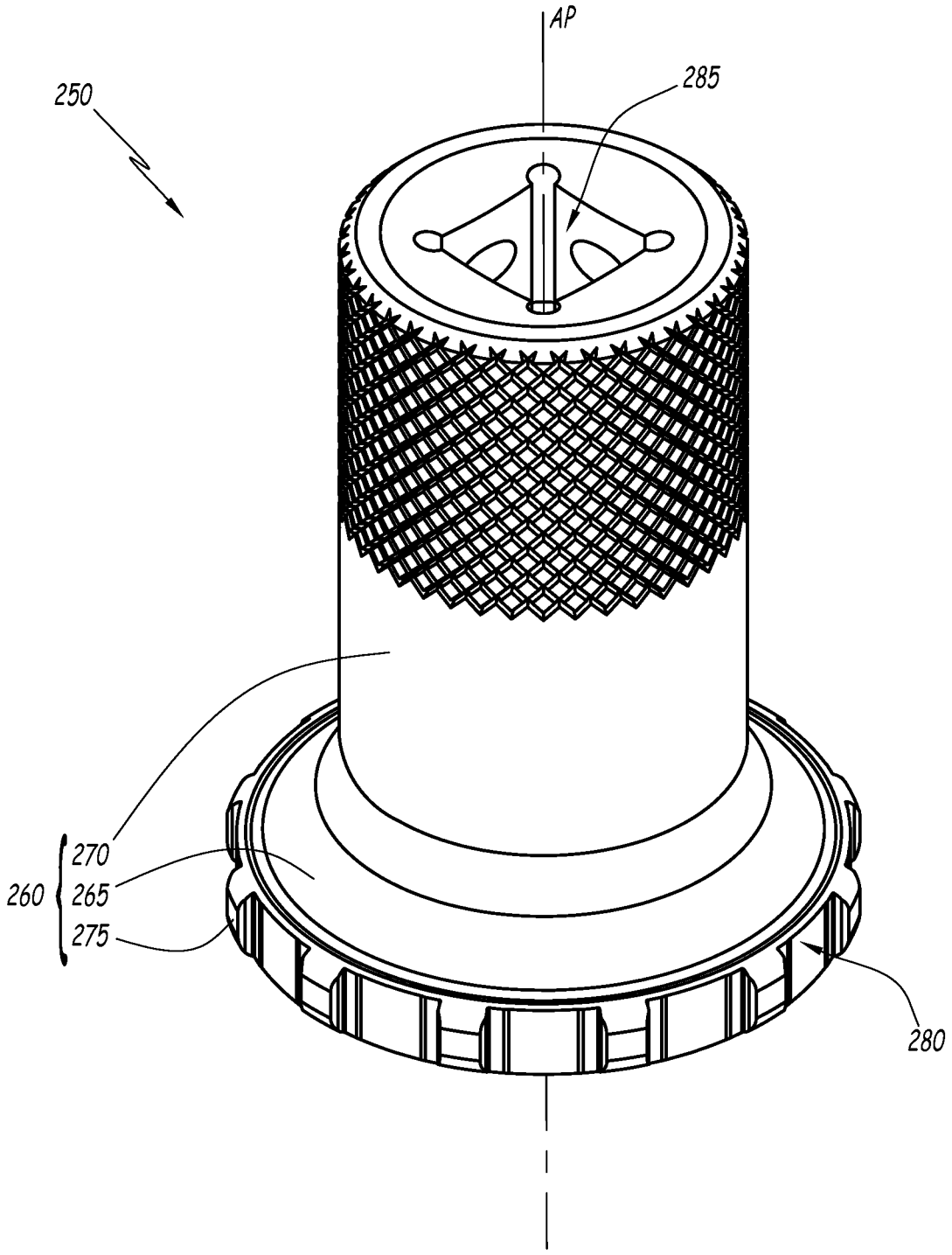
FIG. 8 is a perspective view of a tool provided to rotate the threaded tube of FIG. 5 relative to the turbine body.

The tool 250 comprises a head 260, shown in FIG. 7, and a handle.

The head 260 has a body 265, a base 270, and a set of protrusions 275.

The head 260 is, for example, in one piece.

The head extends along a specific axis AP.

The body 265 has an external face 280 delimiting the body 265 in a plane perpendicular to the specific axis AP.

The external face 280 is cylindrical about the proper axis AP. The external face 280 has a diameter of between 30 mm and 60 mm.

The base 270 is suitable for allowing the handle to be attached to the head 260. For example, the base 270 extends from the body 265 along the specific axis AP and has a recess 285 suitable for interacting with the handle to allow fixing of the handle to the head 260.

Each protrusion 275 extends radially outward from the external face 280 of the body 265.

Each protrusion 275 is designed to be engaged in a notch 245 to drive the threaded tube 190 in rotation. In particular, the protrusions 275 are designed to be engaged simultaneously in the notches 245 by a translational movement of the tool 250 along the specific axis AP, the specific axis AP coinciding with the common axis A of the spraying device 20.

Each protrusion 275 has a thickness, measured in a plane perpendicular to the specific axis AP, from the external face 280, of between 0.5 mm and 5 mm.

The handle is designed to be fixed to the head and to drive the head 260 in rotation about the own axis AP.

According to one embodiment, the handle is suitable for allowing an operator to control a tightening torque transmitted by the tool 250 to the tube 190. For example, the handle is a torque wrench, one head of which is engaged in the recess 285 to drive the head 270 in rotation about the specific axis AP.

It should be noted that other types of tools are likely to be considered for driving the threaded tube 190 in rotation relative to the turbine body 50, in particular if the shape of the threaded tube 190 and in particular the shape and/or the number of notches 245 are modified.

Thanks to the use of the threaded tube 190, the skirt 35 is effectively pressed against the first end face 90 by the engagement of the two threads 195 and 240. The skirt 35 is therefore held in position relative to the turbine body 50 without any tool engaging the outside of the skirt 35. The spraying device 20 therefore does not assume that notches are made on the external surface of the skirt 35.

On the contrary, the threaded tube 190 is interposed at least in part between the skirt and the bowl 30 and is therefore protected against the deposition of coating products.

The threaded tube 190 therefore allows a more reproducible clamping of the skirt 35 against the turbine body 50, and more precise positioning.

The shoulder 225 effectively blocks the threaded tube 190 in translation along the common axis A while allowing rotation about this axis. A turbine body 50 in which the groove 197 for receiving the primary portion 210 is delimited along the common axis A by two parts 50C and 50D separate from the turbine body 50 makes it possible to easily fix the tube 190 to the turbine body 50 by placing the primary portion 210 in the groove 197 of the third part 50C then by fixing the fourth part 50D to the third part 50C.

When the length of the primary portion 210 is greater than or equal to 40 mm, the primary portion 210 prevents any particles generated by the friction of the shoulder 225 against the fourth part 50D from being carried away by the gas flows G present in the area between the bowl 30 and the skirt 35.

The non-cylindrical configuration of the internal face 200 of the secondary portion 215 makes it possible to easily maneuver the tube 190, and in particular to put it in rotation about the common axis A relative to the turbine body 50, from the opening 152. of the skirt 35. The fixing and separation of the skirt 35 and the turbine body 50 are therefore simplified.

The notches 245 make it possible to efficiently maneuver the threaded tube 190 in a simple manner. When they open onto the third end face 237, it is particularly easy to insert the tool 250 by a simple translation in the upstream direction D1.

This is particularly true when, in addition, the bottom of each notch 245 is arranged at a distance less than or equal to half the minimum diameter of the internal face 193 of the skirt 35, since the tool 250 is then inserted through the opening 152 of the skirt 35 for inserting the protrusions 275 into the notches 245. This configuration allows in particular a simple geometry of the tool 250, visible in FIG. 7. This tool 250 allows a very efficient transmission of force since several protrusions 275 are simultaneously inserted into the notches 245.

It should be noted that the mounting of the skirt 35 on the turbine body 50 via the threaded tube 190 is suitable to be implemented in embodiments where the injector 40 is not directly mounted on the body of the turbine. turbine 50.

The invention claimed is:

1. Turbine for a fluid spraying device, comprising:

a turbine body;

a rotor designed to drive a bowl in rotation about a common axis of rotation, the rotor surrounded by said turbine body in a plane perpendicular to the common axis; and a tube having an external face and an internal face, mounted coaxially with said turbine body and intended to be mounted coaxially with a skirt, wherein the tube is movable in rotation about the common axis relative to said turbine body, and wherein said turbine body is designed to prevent translation of the tube with respect to said turbine body parallel to the common axis, the tube comprising:

a primary portion surrounded by said turbine body; and a secondary portion intended to be surrounded by the skirt, the secondary portion being offset in the downstream direction relative to said primary portion, the secondary portion comprising, on the external face, a first thread to engage a second thread formed on the skirt to press the skirt against said turbine body, wherein said turbine body has a first end face delimiting an extremity of said turbine body along the common axis, the skirt bears against the first end face of said turbine body, and the contact between the skirt and the first end face is perpendicular to the common axis.

2. Turbine according to claim 1, wherein said turbine body has a shape designed to allow the flow of air to the skirt.

3. Fluid spraying device comprising:

a bowl;

a turbine according to claim 1; and an injector designed to inject fluid into the bottom of said bowl, wherein the skirt for said turbine at least partially surrounds said bowl in a plane perpendicular to the common axis of said turbine and is designed to eject gas jets to shape sprayed fluid.

4. Fluid spraying device according to claim 3, wherein the external face of the tube of said turbine comprises a shoulder perpendicular to the common axis, and wherein the turbine body of said turbine comprises a support face bearing against the shoulder to prevent translation in the downstream direction of the tube relative to the turbine body.

5. Fluid spraying device according to claim 4, wherein the primary portion of the tube of said turbine is delimited along the common axis by the shoulder and has a length, measured along the common axis, greater than or equal to 5 mm.

6. Fluid spraying device according to claim 3, wherein the turbine body of said turbine comprises at least a first part and a second part fixed to each other, the second part being offset in the downstream direction relative to the first part, the tube of said turbine being at least partially received in a groove delimited in a direction parallel to the common axis by the first part and the second part, the second part bearing against the tube to prevent translation of the tube in the downstream direction relative to the first part.

7. Fluid spraying device according to claim 3, wherein the internal face of the secondary portion of the tube of said turbine has, at at least one point, a normal direction, the normal direction being perpendicular to the internal face at this point, an angle being defined between the normal direction and a segment connecting this point to the common axis, the angle being measured in a plane perpendicular to the common axis and being distinctly greater than 5 degrees.

8. Fluid spraying device according to claim 7, wherein the internal face of the secondary portion comprises a plurality of notches.

9. Fluid spraying device according to claim 8, wherein each notch extends in a direction parallel to the common axis.

10. Fluid spraying device according to claim 9, wherein the tube comprises an end face delimiting the tube along the common axis, the end face facing the downstream direction, each notch opening onto the end face.

11. Fluid spraying device according to claim 10, wherein each notch has a bottom, wherein a distance measured in a plane perpendicular to the common axis between the bottom and the common axis is defined for each notch, wherein the skirt comprises an internal face having a symmetry of revolution about the common axis, wherein a minimum diameter is defined for the internal face of the skirt, and wherein the distance of each notch is less than or equal to half the minimum diameter of the skirt.

12. Fluid spraying device according to claim 8, wherein each notch has a section in a plane perpendicular to the common axis, the section of each notch being a circular arc.

13. Assembly comprising:

a fluid spraying device according to claim 7; and a tool designed to engage the internal face of the secondary portion of the tube of the turbine of said fluid spraying device so as to transmit to the tube a force tending to cause the tube to pivot about the common axis relative to the turbine body of the turbine of said fluid spraying device.

* * * * *